US005871634A

United States Patent [19]

Wiehe et al.

[11] Patent Number: 5,871,634

[45] Date of Patent: Feb. 16, 1999

[54] PROCESS FOR BLENDING POTENTIALLY INCOMPATIBLE PETROLEUM OILS

[75] Inventors: Irwin A. Wiehe, Gladstone; Raymond J. Kennedy, Hampton, both of N.J.

[73] Assignee: Exxon Research and Engineering Company, Florham Park, N.J.

[21] Appl. No.: 763,652

[22] Filed: Dec. 10, 1996

[51] Int. Cl.[6] ..... C10G 9/16

[52] U.S. Cl. ..... 208/48 R; 585/1; 585/950

[58] Field of Search ..... 585/1, 950; 208/48 R

[56] References Cited

U.S. PATENT DOCUMENTS 4,853,337 8/1989 Dickakian ..... 436/55

*Primary Examiner*—Walter D. Griffin
*Assistant Examiner*—Nadine Preisch
*Attorney, Agent, or Firm*—Ronald D. Hantman

[57] ABSTRACT

The present invention includes a method for blending two or more petroleum feedstreams, petroleum process streams, or combination thereof, at least one of which includes the solute asphaltenes so that the asphaltenes remains a solute. The blending method includes the steps of determining the insolubility number, $I_N$, for each feedstream, determining the solubility blending number, $S_{BN}$, for each feedstream, and combining the feedstreams in order of decreasing $S_{BN}$ number of each feedstream such that the solubility blending number of the mixture is greater than the insolubility number of any component of the mix, when the solubility blending number of any of the feedstreams or streams is equal or less than the insolubility number of any of the streams.

10 Claims, No Drawings

PROCESS FOR BLENDING POTENTIALLY INCOMPATIBLE PETROLEUM OILS

The present invention relates to a process for blending two or more petroleum oils and mor particularly blending oils that are potentially incompatible and yet still maintaining compatibility to prevent the fouling and coking of refinery process equipment.

It is well known that petroleum crude oils and asphaltene containing oils derived from petroleum crude oils have the tendency to deposit organic solids, called foulant and coke, on refinery process equipment that contact the oil. Such process equipment include, but are not limited to, pipes, tanks, heat exchangers, furance tubes, fractionators, and reactors. Even small amounts of foulant or coke results in large energy loss because of much poorer heat transfer through foulant and coke as opposed to metal walls alone. Moderate amounts of foulant and coke cause high pressure drops and interfere with and make process equipment operation inefficient. Finally, large amounts of foulant or coke plug up process equipment to prevent flow or otherwise making operation intolerable, requiring the equipment to be shut down and cleaned of foulant and coke.

It is also well known that petroleum derived, asphaltene containing oils that have undergone reaction at high temperatures, above 350° C., have a tendency for rapidly fouling process equipment, either on cooling or by blending with a more paraffinic oil. Such oils include, but are not limited by, the highest boiling distillation fraction after thermally or catalytically hydrothermally converting atmospheric or vacuum resid of petroleum crude and the highest boiling fraction of the liquid product of fluid catalytic cracking, called cat cracker bottoms or cat slurry oil. This rapid fouling is caused by asphaltenes that become insoluble on cooling or on blending with a more paraffinic oil. Here asphaltenes are defined as the fraction of the oil that is soluble when the oil is blended with 40 volumes of toluene but insoluble when the oil is blended with 40 volumes of n-heptane. If the asphaltenes become insoluble at high temperatures, above 350° C., they rapidly form toluene insoluble coke (see I. A. Wiehe, Industrial & Engineering Chemistry Research, Vol. 32, 2447–2454). However, it is not well known that the mere blending of two or more unprocessed petroleum crude oils can cause the precipitation of insoluble asphaltenes that can rapidly foul process equipment or when such crude oil blends are rapidly heated above 350° C., the insoluble asphaltenes can coke pipestill furnace tubes. If the blending of oils causes the precipitation of asphaltenes, the oils are said to be incompatible as opposed to compatible oils that do not precipitate asphaltenes on blending. Thus, incompatible blends of oils have a much greater tendency for fouling and coking than compatible oils. If a blend of two or more oils have some proportion of the oils that precipitate asphaltenes, the set of oils are said to be potentially incompatible. Fortunately, most blends of unprocessed crude oils are not potentially incompatible. It is only for that reason that many refineries can process petroleum crudes for long times without the need to shut down and clean out foulant and coke. Nevertheless, once an incompatible blend of oils is obtained the rapid fouling and coking that results usually requires shutting down the refinery process in a short time. This results in a large economic debit because while the process equipment is cleaned, large volumes of oil cannot be processed. In the past most refineries have learned by trial and error to avoid certain crude oils or not to blend certain processed oils or to reduce the severity of the process in order to make more blendable process oils. However, there has been little understanding of how to predict if the blending of a processed oil with two or more other oils will cause asphaltenes to precipitate. For crude oils and other unprocessed oils the general misconception is that all blends are always compatible.

The blending of oils in a refinery is so common, especially for crude oils, that few, if any, refineries can be economically viable without blending oils. This is both done to be able to produce the most economical range of products and to handle the multiple feedstocks at a refinery that arrive at similar times with limited number of storage tanks.

SUMMARY OF THE INVENTION

The present invention includes a method for blending two or more petroleum feedstreams and/or petroleum process streams, or combinations thereof, at least one of which includes the solute asphaltenes so that the asphaltenes remains a solute. The blending method includes the steps of determining the insolubility number, $I_N$, for each feedstream, determining the solubility blending number, $S_{BN}$, for each feedstream, and combining the feedstreams in order of decreasing $S_{BN}$ number of each feedstream such that the solubility blending number of the mixture is greater than the insolubility number of any component of the mix, when the solubility blending number of any of the feedstreams or streams is equal or less than the insolubility number of any of the streams. $I_N$ and $S_{BN}$ are defined below. The present invention also includes selecting compatible pretroleum feedstream and/or petroleum process streams or combinations thereof.

DESCRIPTION OF THE INVENTION

In the present invention it has been discovered that two or more tests of each petroleum oil with a test liquid containing different proportions of a nonpolar asphaltene solvent and of a nonpolar asphaltene nonsolvent enables predicting if a given blend of oils are potentially incompatible. This is based upon determining the Insolubility Number and the Solubility Blending Number for each petroleum oil in the blend using the petroleum oil tests. Here we mean nonpolar when the molecular structure of the liquid only includes atoms of carbon, hydrogen, and sulfur. Once more, it has been learned that potentially incompatible oils can be processed with little fouling or coking as long as they are blended in the correct order, as predicted from the oil tests, and as long as certain proportions of the oils in the blend are avoided, as also are predicted by the Insolubility Number and the Solubility Blending Number of each oil in the blend as determined by the oil tests.

The first step in determining the Insolubility Number and the Solubility Blending Number for a petroleum oil is to establish if the petroleum oil contains n-heptane insoluble asphaltenes. This is accomplished by blending 1 volume of the oil with 5 volumes of n-heptane and determining if asphaltenes are insoluble. Any convenient method might be used. One possibility is to observe a drop of the blend of test liquid mixture and oil between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and oil on a piece of filter paper and let dry. If the asphaltenes are insoluble, a dark ring or circle will be seen about the center of the yellow-brown spot made by the oil. If the asphaltenes are soluble, the color of the spot made by the oilw ill be relatively uniform in color. If the petroleum oil is found to contain n-heptane insoluble asphaltenes, the procedure described in the next three paragraphs is followed for determining the Insolubility Number and the Solubility Blending Number. If the petroleum oil is found not to contain n-heptane insoluble asphaltenes, the Insolubility Number is assigned a value of zero and the Solubility Blending Number is determined by the procedure described in the section labeled, "Petroleum Oils without Asphaltenes."

Asphaltene Containing Petroleum Oils

The determination of the Insolubility Number and the Solubility Blending Number for a petroleum oil containing asphaltenes requires testing the solubility of the oil in test liquid mixtures at the minimum of two volume ratios of oil to test liquid mixture. The test liquid mixtures are prepared by mixing two liquids in various proportions. One liquid is nonpolar and a solvent for the asphaltenes in the oil while the other liquid is nonpolar and a nonsolvent for the asphaltenes in the oil. Since asphaltenes are defined as being insoluble in n-heptane and soluble in toluene, it is most convenient to select the same n-heptane as the nonsolvent for the test liquid and toluene as the solvent for the test liquid. Although the selection of many other test nonsolvents and test solvents can be made, there use provides not better definition of the preferred oil blending process than the use of n-heptane and toluene described here.

A convenient volume ratio of oil to test liquid mixture is selected for the first test, for instance, 1 ml. of oil to 5 ml. of test liquid mixture. Then various mixtures of the test liquid mixture are prepared by blending n-heptane and toluene in various known proportions. Each of these is mixed with the oil at the selected volume ratio of oil to test liquid mixture. Then it is determined for each of these if the asphaltenes are soluble or insoluble. Any convenient method might be used. One possibility is to observe a drop of the blend of test liquid mixture and oil between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and oil on a piece of filter paper and let dry. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures are ordered according to increasing percent toluene in the test liquid mixture. The desired value will be between the minimum percent toluene that dissolves asphaltenes and the maximum percent toluene that precipitates asphaltenes. More test liquid mixtures are prepared with percent toluene in between these limits, blended with oil at the selected oil to test liquid mixture volume ratio, and determined if the asphaltenes are soluble or insoluble. The desired value will be between the minimum percent toluene that dissolves asphaltenes and the maximum percent toluene that precipitates asphaltenes. This process is continued until the desired value is determined within the desired accuracy. Finally, the desired value is taken to be the mean of the minimum percent toluene that dissolves asphaltenes and the maximum percent toluene that precipitates asphaltenes. This is the first datum point, $T_1$, at the selected oil to test liquid mixture volume ratio, $R_1$. This test is called the toluene equivalence test.

The second datum point can be determined by the same process as the first datum point, only by selecting a different oil to test liquid mixture volume ratio. Alternatively, a percent toluene below that determined for the first datum point can be selected and that test liquid mixture can be added to a known volume of oil until asphaltenes just begin to precipitate. At that point the volume ratio of oil to test liquid mixture, $R_2$, at the selected percent toluene in the test liquid mixture, $T_2$, becomes the second datum point. Since the accuracy of the final numbers increase as the further apart the second datum point is from the first datum point, the preferred test liquid mixture for determining the second datum point is 0% toluene or 100% n-heptane. This test is called the heptane dilution test.

The Insolubility Number, $I_N$, is given by:

$$I_N = T_2 - \left[ \frac{T_2 - T_1}{R_2 - R_1} \right] R_2$$

and the Solubility Blending Number, $S_{BN}$, is given by:

$$S_{BN} = I_N \left[ 1 + \frac{1}{R_2} \right] - \frac{T_2}{R_2}$$

Petroleum Oils Without Asphaltenes

If the petroleum oil contains no asphaltenes, the Insolubility number is zero. However, the determination of the Solubility Blending Number for a petroleum oil not containing asphaltenes requires using a test oil containing asphaltenes for which the Insolubility Number and the Solubility Blending Numbers have previously been determined, using the procedure just described. First, 1 volume of the test oil is blended with 5 volumes of the petroleum oil. Insoluble asphaltenes may be detected by the microscope or spot technique, described above. If the oils are very viscous (greater than 100 centipoises), they may be heated to 100° C. during blending and then cooled to room temperature before looking for insoluble asphaltenes. Also, the spot test may be done on a blend of viscous oils in an oven at 50°–70° C. If insoluble asphaltenes are detected, the petroleum oil is a nonsolvent for the test oil nd the procedure in the next paragraph should be followed. However, if no insoluble asphaltenes are detected, the petroleum oil is a solvent for the test oil and the procedure in the paragraph following the next paragraph should be followed.

If insoluble asphaltenes were detected when blending 1 volume of the test oil with 5 volumes of the petroleum oil, small volue increments of the petroleum oil are added to 5 ml. of the test oil until insoluble asphaltenes are detected. The volume of nonsolvent oil, $V_{NSO}$, is equal to the average of the total volume of the petroleum oil added for the volume increment just before insoluble asphaltenes are detected and the total volume added when insoluble asphaltenes were first detected. The size of the volume increment may be reduced to that required for the desired accuracy. This is called the nonsolvent oil dilution test. If $S_{BNTO}$ is the Solubility Blending Number of the test oil and $I_{NTO}$ is the Insolubility Number of the test oil, then the Solubility Blending Number of the nonsolvent oil, $S_{BN}$, is given by:

$$S_{BN} = S_{BNTO} - \frac{5[S_{BNTO} - I_{NTO}]}{V_{NSO}}$$

If insoluble asphaltenes we re not detected when blending 1 volume of the test oil with 5 volumes of the petroleum oil, the petroleum oil is a solvent oil for the test oil. The same oil to test liquid mixture volume ratio, $R_{TO}$, as was used to measure the Insolubility Number and Solubility Blending Number for the test oil is selected. However, now various mixtures of the test liquid are prepared by blending different known proportions of the petroleum oil and n-heptane instead of toluene and n-heptane. Each of these is mixed with the test oil at a volume ratio of oil to test liquid mixture equal to $R_{TO}$. Then it is determined for each of these if the asphaltenes are soluble or insoluble, such as by the microscope or the spot test methods discussed previously. The results of blending oil with all of the test liquid mixtures are ordered according to increasing percent petroleum oil in the test liquid mixture. The desired value will be between the minimum percent petroleum oil that dissolves asphaltenes and the maximum percent petroleum oil that precipitates asphaltenes. More test liquid mixtures are prepared with percent petroleum oil in between these limits, blended with the test oil at the selected test oil to test liquid mixture volume ratio ($R_{TO}$) and determined if the asphaltenes are soluble or insoluble. The desired value will be between the minimum percent petroleum oil that dissolves asphaltenes and the maximum percent petroleum oil that precipitates asphaltenes. This process is continued until the desired value is determined within the desired accuracy. Finally, the desired value is taken to be the mean of the minimum percent petroleum oil that dissolves asphaltenes and the maximum percent petroleum oil that precipitates asphaltenes. This is the datum point, $T_{SO}$, at the selected test oil to test liquid mixture volume ratio, $R_{TO}$. This test is called the solvent oil equivalence test. If $T_{TO}$ is the datum point measured previously at test oil to test liquid mixture volume ratio, $R_{TO}$, on the test oil with test liquids composed of different ratios of toluene and n-heptane, then the Solubility Blending Number of the petroleum oil, $S_{BN}$, is given by:

$$S_{BN} = 100\left[\frac{T_{TO}}{T_{SO}}\right]$$

Mixtures of Petroleum Oils

Once the Solubility Blending Number is determined for each component the Solubility Blending Number for a mixture of oils, $S_{BNmix}$, is given by:

$$S_{BNmix} = \frac{V_1 S_{BN_1} + V_2 S_{BN_2} + V_3 S_{BN_3} + \ldots}{V_1 + V_2 + V_3 + \ldots}$$

where $V_1$ is the volume of component 1 in the mixture.

The present discovery is that the criterion for compatibility for a mixture of petroleum oils is that the Solubility Blending Number of the mixture of oils is greater than the Insolubility Number of any component in the mixture. Therefore, a blend of oils is potentially incompatible if the Solubility Blending Number of any component oil in that blend is less than or equal to the Insolubility Number of any component in that blend. Once asphaltenes precipitate, it takes on the order of hours to weeks for the asphaltenes to redissolve while it takes of the order of minutes to process the oil in refinery equipment. Thus, to prevent fouling and coking a potentially incompatible blend of oils must be blended to always keep the Solubility Blending Number of the mixture higher than the Insolubility Number of any component in the blend. Thus, both the order of blending and the final proportions of oils in the blend are important. If one starts with the oil of highest Solubility Blending Number and blends the remaining oils in the order of decreasing Solubility Blending Number and if the final mixture meets the compatibility criterion of the Solubility Blending Number of the mixture is greater than the Solubility Number of any component in the blend, then compatibility of the oils throughout the blending process is assured even though the blend of oils is potentially incompatible. The result is that the blend of oils will produce the minimum fouling and/or coking in subsequent processing.

EXAMPLE 1

Potentially Incompatible Crude Oils

A blend of 40% by volume Forties crude with 60% by volume Souedie crude in a refinery was made by adding the heavier crude, Souedie, to the top of a tank partially filled with the lighter crude, Forties. When this blend was processed, black sludge was observed in the desalter, the heat exchangers became fouled, and the furnace tubes in the vacuum pipestill coked rapidly, requiring it to be shut down for cleaning. The Insolubility Number and Solubility Blending Number of each crude was measured following the procedure for asphaltene containing petroleum oils. First the minimum percent toluene in the test liquid to keep asphaltenes in solution, $T_1$, was determined to be 7.5 for Forties and 33 for Souedie at 1 gram of oil and 5 ml. of test liquid composed of mixtures of toluene and n-heptane. Since the density of Forties is 0.791 g/ml and for Souedie is 0.874 g/ml, $R_1$ is 1/[(0.791)5]=0.252 for Forties and 1/[(0.874)(5)]=0.229 for Souedie. The maximum n-heptane that could be added to 5 ml. of oil without precipitating asphaltenes was determined to be 6.9 ml. for Forties and 3.1 ml. for Souedie. Thus, $T_2$ is zero at $R_2$ equal to 5/6.9=0.725 for Forties and 5/3.1=1.61 for Souedie. Therefore:

$$I_N = T_2 - \left[\frac{T_2 - T_1}{R_2 - R_1}\right] R_2$$

$$I_N = 0 - \left[\frac{0 - 7.5}{.725 - .252}\right] .725 \quad I_N = 0 - \left[\frac{0 - 33}{1.61 - .229}\right] 1.61$$

$I_N$=11.5 for Forties $I_N$=38.5 for Souedie $$S_{BN} = I_N\left[1 + \frac{1}{R_2}\right] - \frac{T_2}{R_2}$$

$$S_{BN} = 11.5\left[1 + \frac{1}{.725}\right] - \frac{0}{.725} \quad S_{BN} = 38.5\left[1 + \frac{1}{1.61}\right] - \frac{0}{1.61}$$

$S_{BN}$=27 for Forties $S_{BN}$=62 for Souedie Since the Insolubility Number of Souedie crude is greater than the Solubility Blending Number of Forties crude, these two crudes are potentially incompatible. The onset of incompatibility occurs when:

$$S_{BNmix} = \frac{V_F S_{SBF}}{V_F + V_S} + \frac{V_S S_{BNS}}{V_F + V_S} = I_{NS} = 38.5$$

$$38.5 = \frac{27 V_F}{V_F + V_S} + 64\left[1 - \frac{V_F}{V_F + V_S}\right]$$

$$\frac{V_F}{V_F + V_S} = 0.69$$

Thus, any mixture of Forties and Souedie that is greater than 69% by volume Forties will precipitate asphaltenes and cause increased fouling and coking. As a result, the 40% Forties and 60% Souedie blend of crudes should have been compatible. However, by blending Souedie crude into Forties crude, the initially added Souedie foiled blends with Forties that were greater than 69% Forties. This caused asphaltenes to precipitate. Although, the final composition of the blend was in the compatible region (less than 69% Forties), insoluble asphaltenes require days to weeks to redissolve. As a result, the insoluble asphaltenes caused black sludge in the desalter, fouling of heat exchangers, and coking of the furnace tubes of the vacuum pipestill. The refinery then ran a trial of the same blend of crudes but added the lighter Forties crude to the bottom of a tank partially filled with Souedie crude. The result was that the same final blend of 40% by volume Forties crude and 60% by volume Souedie crude were processed without black sludge in the desalter little fouling, of crude heat exchangers, and no coking of the furnace tubes of the vacuum pipestill.

EXAMPLE xample 2

Potentially Incompatible Process Oils

A refinery hydiotreated a broad mixture of refinery streams: unprocessed atmospheric and vacuum gas oils, 600 neutral lube extract, propane asphalt, fluid catalytic cracker bottoms, light catalytic cycle oil, heavy catalytic cycle oil, and catalytic kerosene oil in a packed bed of heterogeneous catalyst. The top of the catalyst bed where the liquid feed entered plugged in two weeks of operation. The Solubility Blending Numbers and Insolubility Numbers were determined for each stream. Samples (5 ml.) of each of the streams were diluted with 25 ml. of n-heptane and only two streams, propane asphalt and fluid catalytic cracker bottoms were found to contain n-heptane insouble asphaltenes. These two streams were tested following the procedures for petroleum oils with asphaltenes with the results in the following table.

| Refinery Stream | $R_1$ | $T_1$ | $R_2$ | $T_2$ | $I_N$ | $S_{BN}$ |
|---|---|---|---|---|---|---|
| Propane Asphalt | 0.200 | 7.0 | 0.286 | 0.0 | 23.3 | 105 |
| Fluid Catalytic Cracker Bottoms | 0.180 | 74 | 2.27 | 0.0 | 80.4 | 116 |

This showed that the fluid catalytic cracker bottoms containined the more insoluble asphaltenes. Therefore, the fluid catalytic cracker bottoms was selected to be the test oil for the streams that contained no asphaltenes. Samples (25 ml.) of each of the remaining streams were mixed with 5 ml. of fluid catalytic cracker bottoms and atmospheric gas oil, vacuum gas oil, and catalytic kerosene oil precipitated asphaltenes from the fluid catalytic cracker bottoms. Thus, the maximum volume, $V_{NSO}$, of each of these three streams that could be blended with 5 ml. of fluid catalytic cracker bottoms was determined and the Solubility Blending Number of each was calculated using the following equation:

$$S_{BN} = I_{NTO} - \frac{5[S_{BNTO} - I_{NTO}]}{V_{NSO}} = 80 - \frac{5[116 - 80]}{V_{NSO}} = 80 - \frac{180}{V_{NSO}}$$

The results are given in the following table:

| Catalytic Kerosene Oil | $V_{NSO}$ | $S_{BN}$ | $I_N$ |
|---|---|---|---|
| Atmospheric Gas Oil | 5.5 | 47 | 0 |
| Vacuum Gas Oil | 5.5 | 47 | 0 |
| Catalytic Kerosene Oil | 16.25 | 69 | 0 |

The remaining streams, 600 neutral lube extract, light catalytic cycle oil, and heavy catalytic cycle oil, were each blended with n-heptane in various proportions to form test liquids. Each of these test liquids was blended with fluid catalytic cracker bottoms at a ratio of 0.9 ml. of fluid catalytic cracker bottoms to 5 ml. of test liquid and the asphaltenes were determined to be soluble or insoluble by the microscope and filter paper spot tests. For each stream the minimum volume percent in the test liquid to keep the asphaltenes of the fluid catalytic cracker bottoms in solution was determined. Then the Solubility Blending Number of each stream was calculated from the following equation:

$$S_{BN} = 100\left[\frac{T_{TO}}{T_{SO}}\right] = 100\left[\frac{74}{T_{SO}}\right]$$

The results are given in the following table:

| Refinery Stream | $T_{SO}$ | $S_{BN}$ | $I_N$ |
|---|---|---|---|
| 600 Neutral Lube Extract | 53 | 140 | 0 |
| Light Catalytic Cycle Oil | 47 | 157 | 0 |
| Heavy Catalytic Cycle Oil | 37 | 200 | 0 |

With the Solubility Blending Number of each refinery stream, the Solubility Blending Number of the mixture of streams that caused the plugging problem was calculated as the sum of the volume fraction times the Solubility Blending Number for each steam with results as follows:

| Order of Mixing | Refinery Stream | Volume Fraction | $S_{BN}$ |
|---|---|---|---|
| 1 | Atmospheric Gas Oil | 0.34 | 47 |
| 2 | Vacuum Gas Oil | 0.30 | 47 |
| 3 | Catalytic Kerosene Oil | 0.06 | 69 |
| 4 | Light Catalytic Cycle Oil | 0.06 | 157 |
| 5 | Heavy Catalytic Cycle Oil | 0.03 | 200 |
| 6 | Fluid Catalytic Cracker Bottoms | 0.11 | 116 |
| 7 | 600 Neutral Lube Extract | 0.05 | 140 |
| 8 | Propane Asphalt | 0.05 | 105 |
| | Mixture | 1.00 | 75 |

Since the Solubility Blending Number of the mixture, 75, was less than the Insolubility Number of Fluid Catalytic Cracker Bottoms, 80, asphaltenes were insoluble in the feed to the hydrotreater. In addition, since the streams were mixed in the order listed above with the streams of poorest solvency first, the potential existed for insoluble asphaltenes even when the overall mix was compatible. Therefore, the order of mixing was reversed to blend the better solvent oils before the fluid catalytic cracker bottoms and add the poorer solvent oils after the fluid catalytic cracker bottoms. In addition, the amount of atmospheric and vacuum gas oils was reduced to 0.50 volume fraction or less with the other oils in about the same proportion to each other. This maintained the Solubility Blending Number of the mixture to be higher than Insolubility Number of the Fluid Catalytic Cracker Bottoms as is shown in the table below.

| Order of Mixing | Refinery Stream | Volume Fraction | $S_{BN}$ |
|---|---|---|---|
| 1 | 600 Neutral Lube Extract | 0.07 | 140 |
| 2 | Propane Asphalt | 0.07 | 105 |
| 3 | Light Catalytic Cycle Oil | 0.08 | 157 |
| 4 | Heavy Catalytic Cycle Oil | 0.05 | 200 |

-continued

| Order of Mixing | Refinery Stream | Volume Fraction | $S_{BN}$ |
|---|---|---|---|
| 5 | Fluid Catalytic Cracker Bottoms | 0.15 | 116 |
| 6 | Catalytic Kerosene Oil | 0.08 | 69 |
| 7 | Atmospheric Gas Oil | 0.27 | 47 |
| 8 | Vacuum Gas Oil | 0.23 | 47 |
| | Mixture | 1.00 | 86 |

With the correct order of blending and with the Solubility Blending Number of the mixture greater than the Insolubility Number of the Fluid Catalytic Cracker Bottoms, the hydrotreater made a test run of 6 months of operation without significant pressure increase across the packed bed.

What is claimed is:

1. A method for blending two or more petroleum feedstreams, petroleum process streams, or combinations thereof, at least one of which includes solute asphaltenes so that said asphaltenes remain a solute and thus minimize fouling or coking of process equipment at or downstream of the blending comprising:

(a) determining the insolubility number, $I_N$, for each feedstream or process stream, (b) determining the solubility blending number, $S_{BN}$, for each feedstream or process stream, (c) combining said feedstreams or process streams such that the solubility blending number of the mixture is always greater than the insolubility number of any component of the mix when the solubility blending number of any of the feedstream or process streams is equal or less than the insolubility number of any of the feedstreams or process streams.

2. The method of claim 1 wherein the feedstreams or process streams are combined in order of decreasing $S_{BN}$ and the final mixture $S_{BN}$ is greater than $I_N$ for any component in the mixture.

3. The method of claim 1 wherein the insolubility number and the solubility blending number are determined from the toluene equivalence test and the heptane dilution test for each stream containing asphaltenes.

4. The method of claim 1 wherein the insolubility number is zero and the solubility blending number is determined from either the solvent oil equivalence test or the nonsolvent oil dilution test for each stream containing no asphaltenes.

5. The method of claim 1 wherein said solubility blending number of the mixture of M petroleum and process streams is determined by $$S_{BNmix} = \frac{V_1 S_{BN_1} + V_2 S_{BN_2} + \ldots + V_M S_{BN_M}}{V_1 + V_2 + \ldots + V_M}$$

where $V_i$ is the volume of the $i^{th}$ stream, i=1, . . . M.

6. A method of selecting compatible petroleum feedstreams, petroleum process streams, or combinations thereof, for blending comprising:

(a) determining the insolubility number, $I_N$, for each feedstream or process stream (b) determining the solubility blending number, $S_{BN}$, for each feedstream or process stream, (c) selecting the feedstreams or process streams that can be combined such that the solubility blending number of the mixture is always greater than the insolubility number of any component of the mixture when the solubility blending number of any feedstreams or streams is equal or less than the insolubility number of any of the feedstreams or process streams.

7. The method of claim 6 wherein the feedstreams or process streams are combined in order of decreasing $S_{BN}$ and the final mixture $S_{BN}$ is greater than $I_N$ for any component in the mixture.

8. The method of claim 6 wherein the insolubility number and the solubility blending number are determined from the toluene equivalence test and the heptane dilution test for each stream containing asphaltenes.

9. The method of claim 6 wherein the insolubility number is zero and the solubility blending number is determined from either the solvent oil equivalence test or the nonsolvent oil dilution test for each stream containing no asphaltenes.

10. The method f claim 6 wherein said solubility blending number of the mixture of M petroleum and process streams is determined by $$S_{BNmix} = \frac{V_1 S_{BN_1} + V_2 S_{BN_2} + \ldots + [V_N S_{BN_N}] V_M S_{BN_M}}{V_1 + V_2 + \ldots + [V_N] V_M}$$

where $V_i$ is the volume of the $i^{th}$ stream, i=1, . . . M.

* * * * *